US005950341A

United States Patent [19]

Cross

[11] Patent Number: 5,950,341

[45] Date of Patent: Sep. 14, 1999

[54] DISPLAY DEVICE AND EASEL

[76] Inventor: James Allin Cross, 1720 Scott St., St. Helena, Calif. 94574

[21] Appl. No.: 08/926,093

[22] Filed: Sep. 9, 1997

[51] Int. Cl.[6] ..... A47G 1/06

[52] U.S. Cl. ..... 40/750; 40/789

[58] Field of Search ..... 40/755, 789, 780, 40/786, 788, 750

[56] References Cited

U.S. PATENT DOCUMENTS

| | | | |
|---|---|---|---|
| 1,839,814 | 1/1932 | Taylor | 40/750 |
| 2,324,027 | 7/1943 | Rosenberg et al. | 40/755 |
| 2,443,645 | 6/1948 | Turan | 40/750 |
| 2,991,578 | 7/1961 | Messina | 40/750 |
| 3,545,115 | 12/1970 | Nichols | 40/750 |
| 4,309,835 | 1/1982 | Naeve | 40/310 |
| 4,379,373 | 4/1983 | Transport | 40/750 |
| 4,559,727 | 12/1985 | Lewyt . | |
| 4,662,093 | 5/1987 | Suttles et al. . | |
| 4,738,041 | 4/1988 | Drueck, Jr. . | |
| 4,780,975 | 11/1988 | Friedman | 40/755 |
| 4,825,574 | 5/1989 | George . | |
| 4,870,766 | 10/1989 | Topping . | |
| 4,965,946 | 10/1990 | Hegedus et al. | 40/124.4 |
| 5,303,487 | 4/1994 | Olson . | |
| 5,337,949 | 8/1994 | Seeley | 229/92.8 |
| 5,361,521 | 11/1994 | Burtch | 40/789 X |
| 5,365,684 | 11/1994 | Cartmell . | |
| 5,513,455 | 5/1996 | Walker | 40/788 |
| 5,678,339 | 10/1997 | Marventano | 40/789 |

*Primary Examiner*—Joanne Silbermann
*Attorney, Agent, or Firm*—Christie, Parker & Hale, LLP

[57] ABSTRACT

A one-piece paperboard picture frame with self contained easels. The frame is fabricated from a single piece of paperboard divided into three foldable panels which are die-cut according to a predetermined pattern to create a display opening and easels for supporting the frame in a horizontal or vertical orientation. Cutouts for finger holes are provided for use of opening the easels. Mounting holes are provided to enable hanging of the frame in a horizontal or vertical orientation. The frame opening is provided with die-cut flaps which are folded inwardly and secured in die-cut slots to receive and securely hold the photo to be mounted therein in a rectangular opening. The cooperative interconnection of the frame flaps and slots space the front panel from the next adjacent panel and create a depth and a three dimensional aspect to the frame at the display opening in which a photo is to be mounted.

10 Claims, 7 Drawing Sheets

10
18
60
18
42
62
44
40
38
18

DISPLAY DEVICE AND EASEL

BACKGROUND OF THE INVENTION

This invention relates to a display device and easel for displaying pictures and photographs and more particularly to an improved photo frame and stand.

Paperboard frames for displaying photographs and pictures are well known and staple items that have existed for a considerable period of time. The patent prior art is extensive. A substantial number of prior patents involve designs in which the frame is assembled from a single sheet of paperboard or card stock, which is suitably scored and die-cut to provide the joints, tabs and slots to facilitate initial fabrication and assembly and later final mounting of the photo by the end user.

Examples of such prior art include a photo easel and self mailer as exemplified by U.S. Pat. No. 5,337,949. In this design, a display frame is provided, which is, in effect, reversible. With the panels folded to one side, the display device is structured to serve as a mailer. With the panels reversed, the device serves as a frame and self-contained easel with slots to receive the corners of a photograph.

Another example is the device shown in U.S. Pat. No. 4,738,041. This device, when its flaps are folded to one side of the central portion, forms a frame extending around a periphery of the device which is generally triangular in cross section to provide a groove in which a picture or photo can be inserted and supported on at least three sides, usually in conjunction with strategically located slots for receiving the edges of the picture.

Other examples of prior art devices are shown, for example, in U.S. Pat. Nos. 4,309,835, "Foldable Frame Structure;" 4,870,766, "Picture Support;" 5,513,455, "Three Dimensional Matte-Frame System;" 4,965,946, "Display Card or Mount;" and 5,365,684, "Origami Style Foldable Picture Frame From a Unitary Blank of Sheet Material."

Display devices of the prior art were not efficiently designed, did not provide a depth and three dimensional aspect to the display of photographs and did not incorporate a positive locking configuration to securely hold the photograph in position in the display area of the frame. A need exists for creating frames that can be used in recreational settings and that can be customized to include designs, such as, logos, trademarks and service marks of the company conducting the recreational activity. A need also exists for providing photo frames at an economical price that nevertheless have a stylization that enhances and provides a professional look to the frame. In particular, there exists a need for low cost frames that can receive printing which simulates stylization, such as a leather covered frame, a gold leaf covered frame, a wood frame and other simulated metallic types of frames. A need also exists for a highly functional frame that is suited for use with the sale of photographs from one-hour photo finishing operations.

SUMMARY OF THE INVENTION

The present invention responds to and satisfies the needs outlined above by providing a display device which comprises an integral flat sheet of paperboard material which is divided into first, second, and third panels each panel being approximately equal in size. The panels are connected by folding joints with the third panel being adapted to be folded over the second panel and the first panel over the second and third panels. The first panel has an opening of a predetermined size and configuration defined by four foldable flaps located at right angles to each other which have been die-cut from the flat sheet and suitably scored to permit each to be folded under the first panel. Three elongated tabs are die-cut into the outer periphery of the first panel along its free edges. These tabs are adapted to be folded over the periphery of the second and third panels and secured to the back of the second panel to create a frame assembly. The second panel has at least one easel and an easel supporting tab die-cut into the panel, selected edges of the easel and tab being scored instead of die-cut for ease of folding. The third panel has four slots, each of a predetermined configuration which are die-cut into the panel. These slots are positioned, shaped and oriented so as to engage respective ones of the foldable flaps of the first panel when the display device is put into use to mount and display a photograph or other pictorial matter.

The display device of the present invention includes a display assembly which is formed from an integral pre-cut sheet of material which is die-cut and scored according to a specific pattern to form a central display area which includes a foldable flap along each edge of the central display area and a central knock-out portion. These foldable flaps are scored to permit the flaps to be folded under each edge of the central display area of the first panel to form a frame about the central display area.

In one embodiment, the frame is rectangular in outline and the central display area is likewise rectangular in outline. A square frame is also contemplated with a square central display area. When folded by the end user, the flaps are engaged into slots which have been die-cut into the panel which is directly behind the front panel. The foldable flaps each engage with an associated slot such that the foldable flaps are secured to the adjacent panel immediately behind the front panel to form a mounting for holding the photograph securely in the frame. The engagement of the flaps with the slots causes the front panel to be spaced from the adjacent panel behind it to provide a three dimensional or depth effect to the display frame, enhancing the ability of the frame to properly display the photograph.

The display device of the present invention is divided into three panels, which are folded one over the other and secured together by using adhesives or glue applied to peripheral tabs provided on the front panel. When the three panels are folded together, the tabs with glue or adhesive applied to their inner surface are folded over and secured to the back panel. The display device of the present invention lends itself to utilization in applications and is particularly suited, with the proper color printing on the front face of the frame to present a certain style or to display certain themes. For example, the frames of the present invention lend themselves to be utilized in such uses as on cruise ships, in resorts, amusement parks and with travel groups to display the logos and service marks of the businesses operating the cruises, etc.

The frame of the present invention is provided with one or more incorporated easels which are die-cut into the back panel of the three panel assembly. The die-cut easels are placed so as to enable the frame to be displayed with the long axis of the photograph horizontal to the surface on which the display device is mounted or vertical to the surface on which the display device is mounted. Holes or apertures are also provided in the back panel to allow the picture to be similarly hung with the long axis either horizontal or vertical.

In one aspect of the invention the display device conveniently lends itself to having appropriate designs and styling color printed on a large sheet of paper board. Thereafter individual display devices are die cut from the paper board prior to being folded and secured into the frame configuration. After assembly into a frame configuration, the foldable flaps in the center of the front panel remain substantially flat to facilitate packing the display device into multiple packs and for compactness to increase the number of units that can be shipped or stored per unit volume. In another aspect, the display device is adapted for mounting on a display surface, such as, a desk or counter top without requiring any other supporting structure. Furthermore, the display device is capable of manufacturing from paperboard, card stock or similar materials which are inexpensive, lightweight and can be easily and inexpensively assembled.

BRIEF DESCRIPTION OF THE DRAWINGS

These and other aspects of the invention will be better understood by reference to the following drawings wherein.

DETAILED DESCRIPTION OF THE INVENTION

Figure 1:
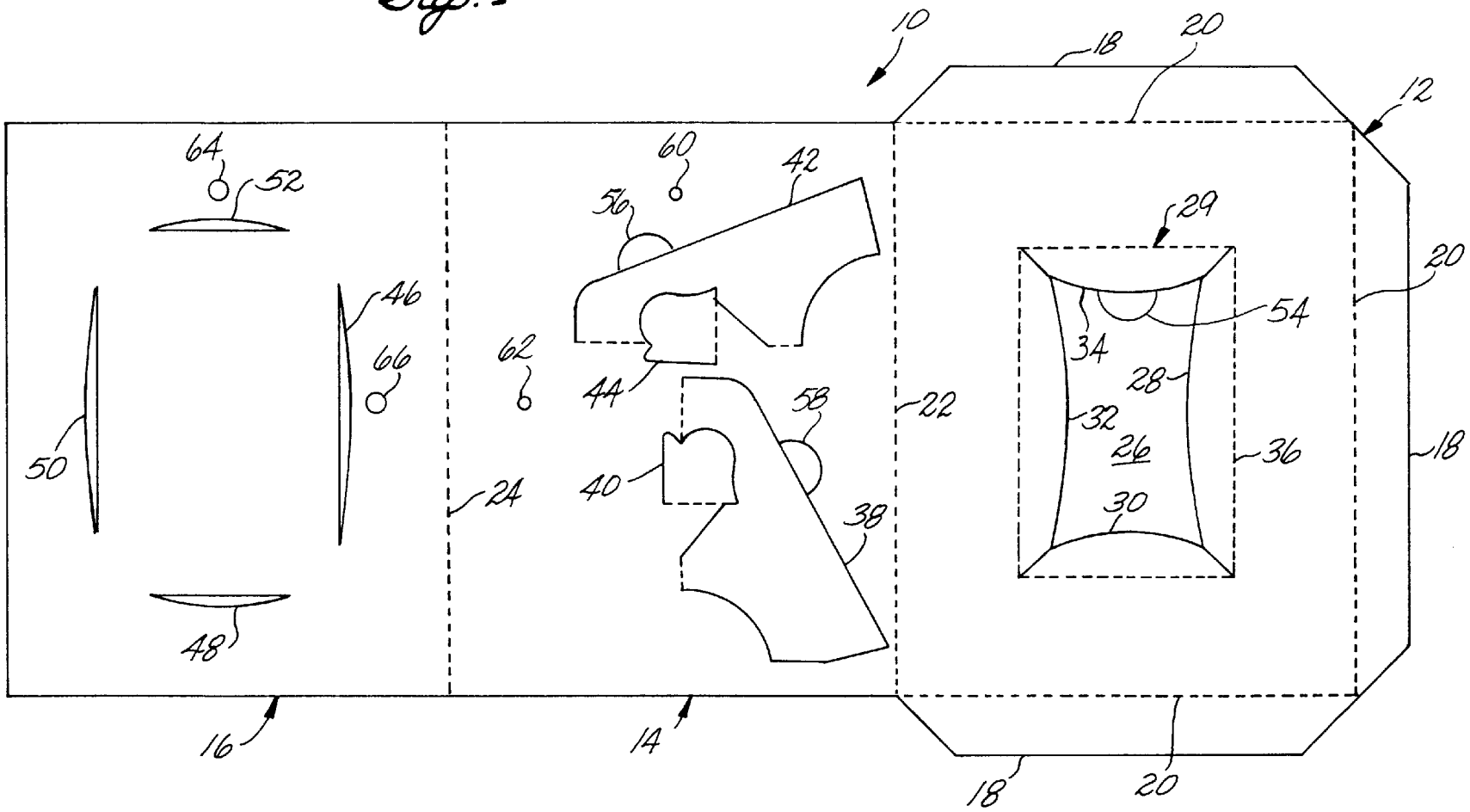
FIG. 1 is a plan view of a preferred embodiment of the display device of the present invention after it has been cut from sheet stock and die-cut and scored prior to being assembled into a frame configuration.

A preferred form of a display device 10 of the present invention is cut from a larger preprinted sheet in the configuration shown in FIG. 1 such that first panel 12 is provided with tabs 18 of a predetermined trapezoidal configuration formed along the free edges of first panel 12. Scoring lines 20 are provided between the tabs and panel 12 to facilitate the folding of the tabs inwardly over the frame when the three panels are folded together and assembled. Scoring line 22 is located between the first panel 12 and second panel 14 to provide a joint connecting the two panels and facilitating the folding of the two panels together. Another scoring line 24 is provided between panel 14 and panel 16 to provide another preformed joint to facilitate the folding of the third panel with respect to the second panel.

Turning now to the first panel 12, a removable center piece 26 is die-cut into the center of the first panel. Centerpiece 26 is generally rectangular and is bordered by four arcuate foldable flaps 28, 30, 32 and 34. Each of the flaps 28–34 is joined to the body of panel 12 along a scored line 36. As will be discussed in greater detail below, the flaps 30–34 are adapted to be folded inwardly and under scored line 36 of the first panel at the time when the frame is put into actual use in the process of mounting a photograph or picture in the display device opening 29 which is defined by the four sections of scored line 36.

Second panel 14 is located between panel 16 and panel 12 and has a pair of easels and easel mounting flaps die-cut into the body of the panel. First easel 38 is provided for mounting the assembled device with the longitudinal axis of the display device in a vertical orientation. The assembly and use of the easel will be described in greater detail at a later point in this description. Also, provided is an easel mounting flap 40 which is engaged with the easel 38 to support and lock the easel in position and permit the easel to provide its display device supporting function. A second easel 42 is also die-cut into the second panel. This easel has a orientation which is rotated 90° from the orientation of easel 38 to permit a display device to be mounted with the longitudinal axis in a horizontal orientation. Easel 42 likewise has an easel mounting flap 44 which engages and locks into easel 42. The bottom of easel 42 rests on a display surface. Finger holes 56, 58 are die cut into panel 14 to facilitate the deployment of easels 38, 42.

The third panel 16 has a series of slots 46, 48, 50 and 52 located at right angles to each other. As shown in FIG. 1 these slots have straight innermost sides and curved outermost sides in configuration. Slots 46 and 50 are elongated and correspond to the longitudinal axis of the rectangle and are adapted to be engaged with foldable flaps 28 and 32 when a photograph is to be mounted into the frame or the display device. Slots 48 and 52 are shorter in length than the slots 46, 50 and are adapted to be engaged with flaps 30 and 34 in the first panel. Slots 48, 52 correspond to the width dimension of the rectangle.

Holes or apertures are also provided in the panels 14, 16 to enable the frame to be hung with its longitudinal axis either horizontal or vertical. As shown in FIG. 1 apertures 60, 62 are punched or die cut into panel 14. Similarly a second pair of apertures 64, 66 having a diameter equal to or greater than apertures 60, 62 are punched or die cut into panel 16 and are positioned so as to register with apertures 60, 62 when panel 16 is folded over panel 14. When the frame is fully assembled, a nail or hook mounted on a wall engages either aligned apertures 60, 64 or aligned aperture 62, 66 to enable the frame to be hung.

In fabricating the display device of the present invention, one or more sets of decorative patterns are first printed on one side of a large sheet of paper board, each set corresponding to an individual display device when the fabrication process is complete. Thereafter the large sheet of paper board imprinted with patterns is transferred to the next station in the fabrication process, an apparatus or machine where die cutting, scoring and cutting operations are carried out. The die cutting and scoring machine cuts each individual display device from the large sheet and at the same time die cuts the removable centerpiece 26 in the first panel 12, scores the flaps 18, tabs 28, 30, 32, 34 and joints, die cuts the easels 38, 42 in second panel 14 and the slots 46, 48, 50, 52 in the third panel 16. The result is the unfolded display device shown in FIG. 1.

Figure 6:
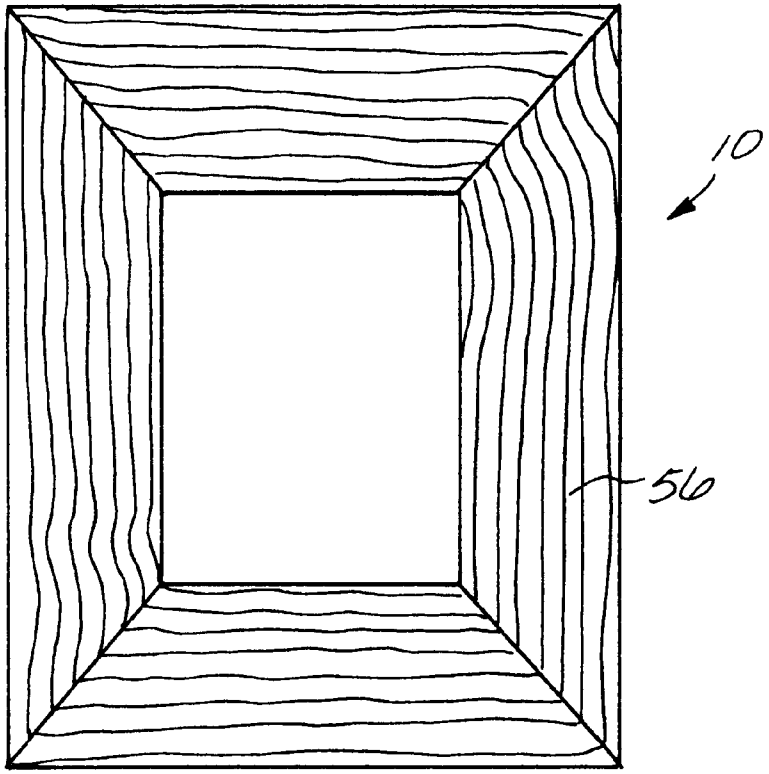
FIG. 6 is a plan view of the display device of the present invention with a wood grain pattern printed on the front panel to simulate a wood picture frame.

The pattern printed on the display device is an integral, important aspect of the invention in creating a low cost, lightweight, simulated picture frame that looks very much like a frame made of wood, metal, leather, etc. The decorative patterns presently contemplated by the invention include but are not limited to simulated leather, simulated wood grain, simulated metal and other decorative material and slogans including trademarks, logos and messages such as "Merry Christmas." As presently contemplated, printing is done by offset lithography four color process. A display device according to the present invention with a simulated wood grain 56 printed on the front panel is shown in FIG. 6.

The die-cutting/scoring machine scores each individual sheet to produce the scoring lines 22, 24 which provide the folding joints between the panels, and the scoring lines 36 which define the base of the tabs 28, 30, 32, 34 in the photo display area of the device. After the scored and die-cut sheet of FIG. 1 has been produced, extraneous edges and holes in the die-cut sheets are removed to produce a blank that is ready for movement to the next step in the assembly process.

Figure 2:
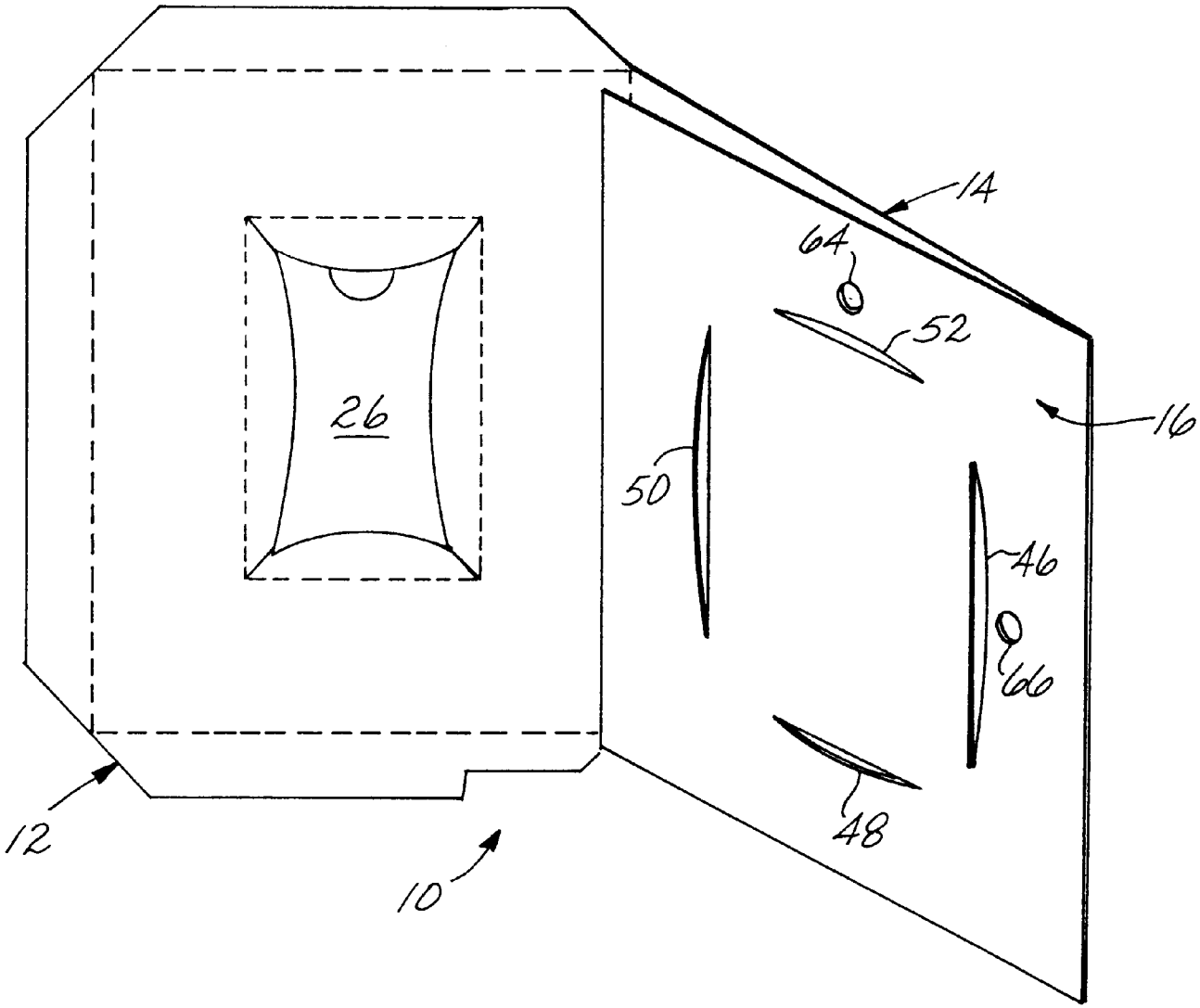
FIG. 2 is a perspective view of the device of FIG. 1 with an intermediate panel folded over the rear panel.
Figure 4:
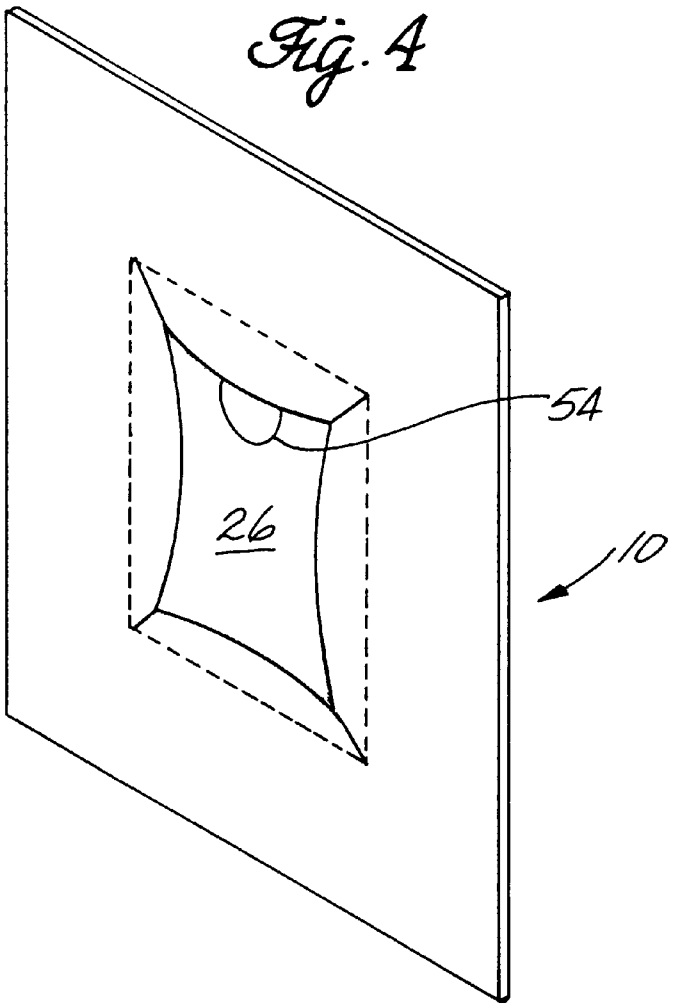
FIG. 4 is a perspective view of the device of FIG. 3 with the peripheral flaps of the front panel being folded over the free edges of the intermediate and rear panels.
Figure 3:
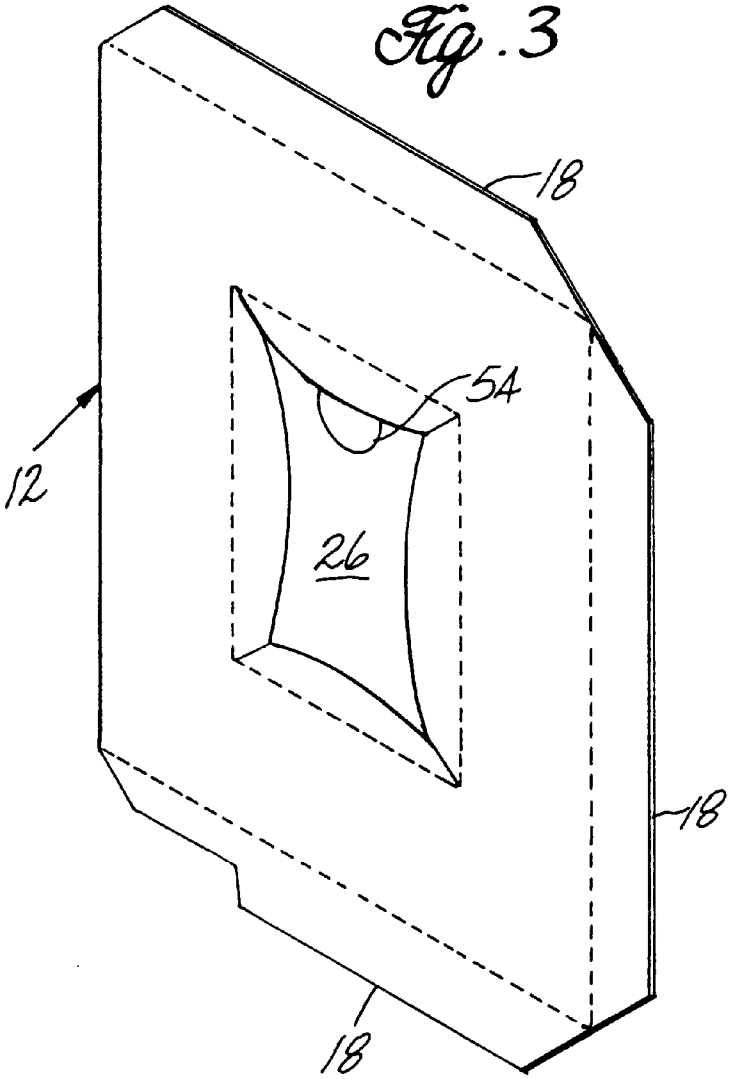
FIG. 3 is a perspective view of the device of FIG. 2 with the front panel folded over the intermediate and rear panels.
Figure 8:
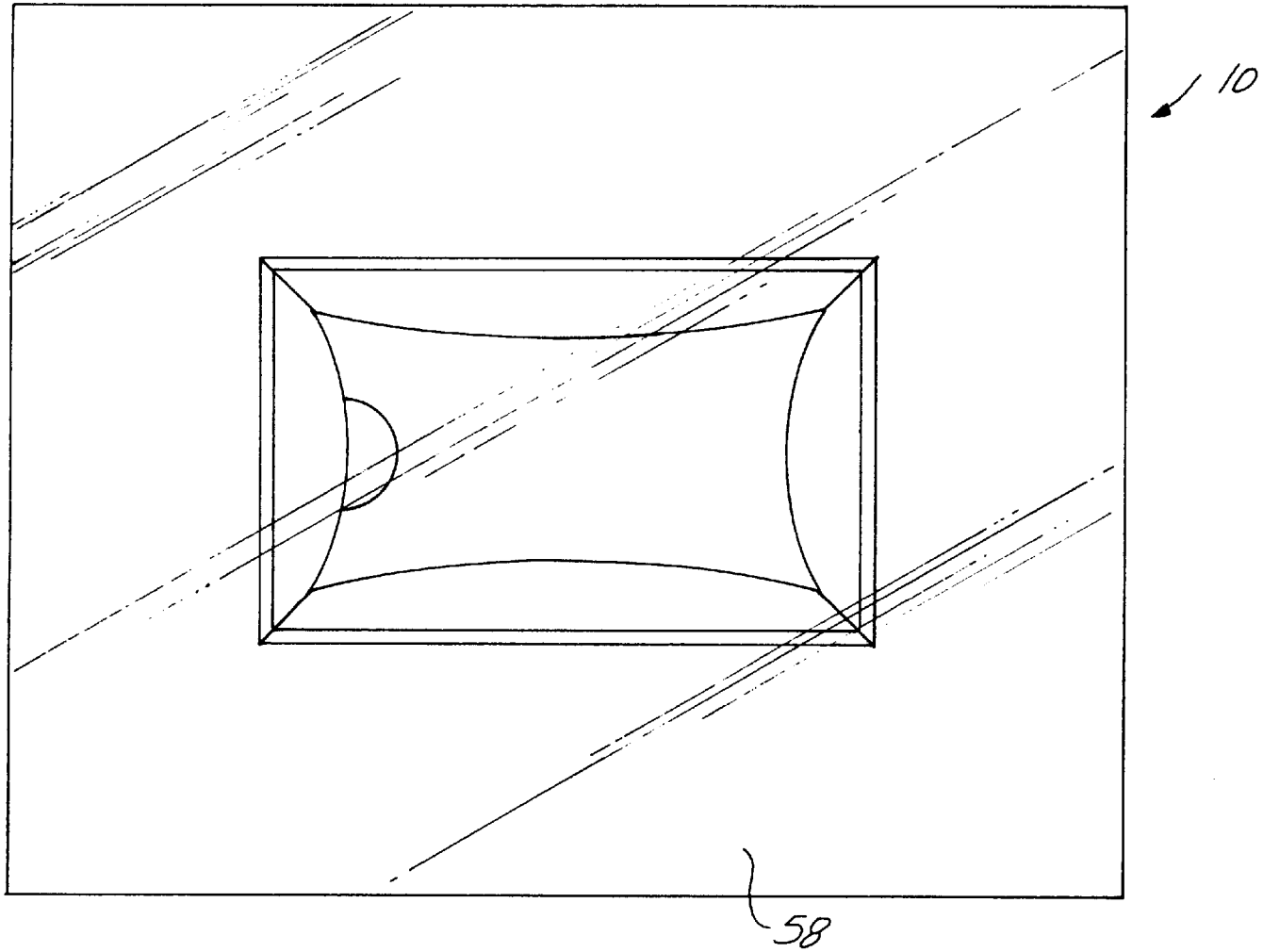
FIG. 8 is a plan view of the display device of the present invention after it has been assembled and is ready for shipment.

The sheet is then transferred to a folder/gluer machine which folds the pre-cut and scored printed device 10 into thirds. Referring now to FIG. 2, the device 10 is shown in an intermediate folded state with panel 16 folded over panel 14. In the next step the folding apparatus folds panel 12 over panels 14, 16 as shown in FIG. 3. The folding/gluing machine then applies glue or adhesive to tabs 18 and folds them down over the edges of the three panel assembly as shown in FIG. 4. The assembled product is then packaged singly or in multiple packs and shipped in a flat sandwich configuration as shown in FIG. 8. Typically the wrapping 58 is transparent to display the decorative pattern of the top display device in the pack.

Figure 5:
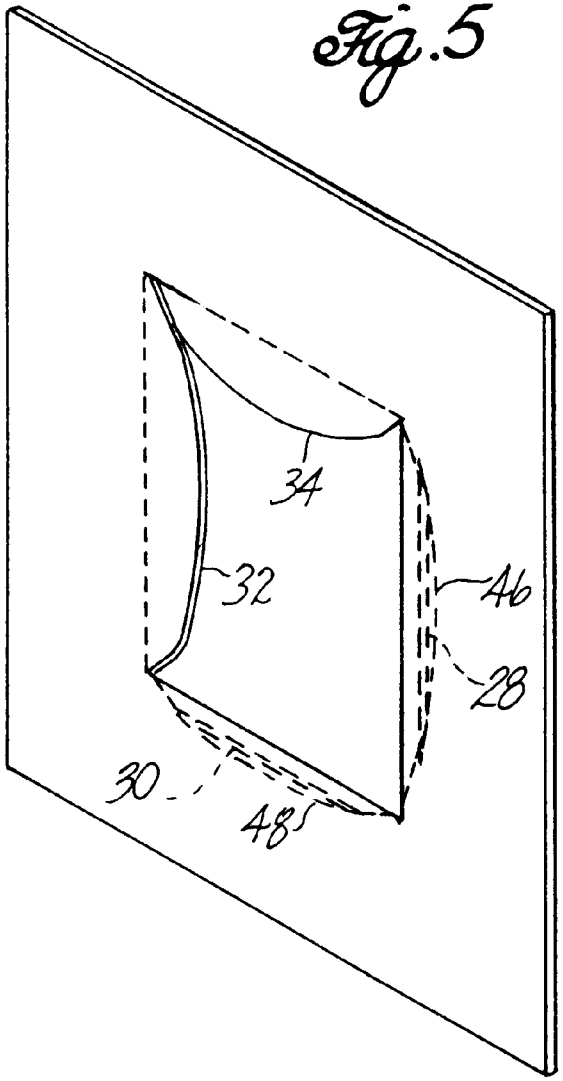
FIG. 5 is a perspective view of the display device of FIG. 4 with a pair of opposed flaps in the central opening folded under the front panel and engaging receiving slots die-cut into the intermediate panel.

In actual use by the end user, the frame is taken by the user who removes central portion 26 by means of finger hole 54, thereby exposing the curved edges of the foldable flaps 28, 30, 32, 34. As shown in FIG. 5, two flaps such as flap 28 and flap 30 are folded under their respective edges of the display area and are engaged with slots 46, 48 respectively. A picture such as a 4×6 photograph is inserted into the display area under flaps 32, 34. The picture is then slid into the corner formed by flaps 28, 30 engaged in their respective slots. Flaps 32 and 34 are next folded under the central opening to engage slots 50, 52.

Figure 9:
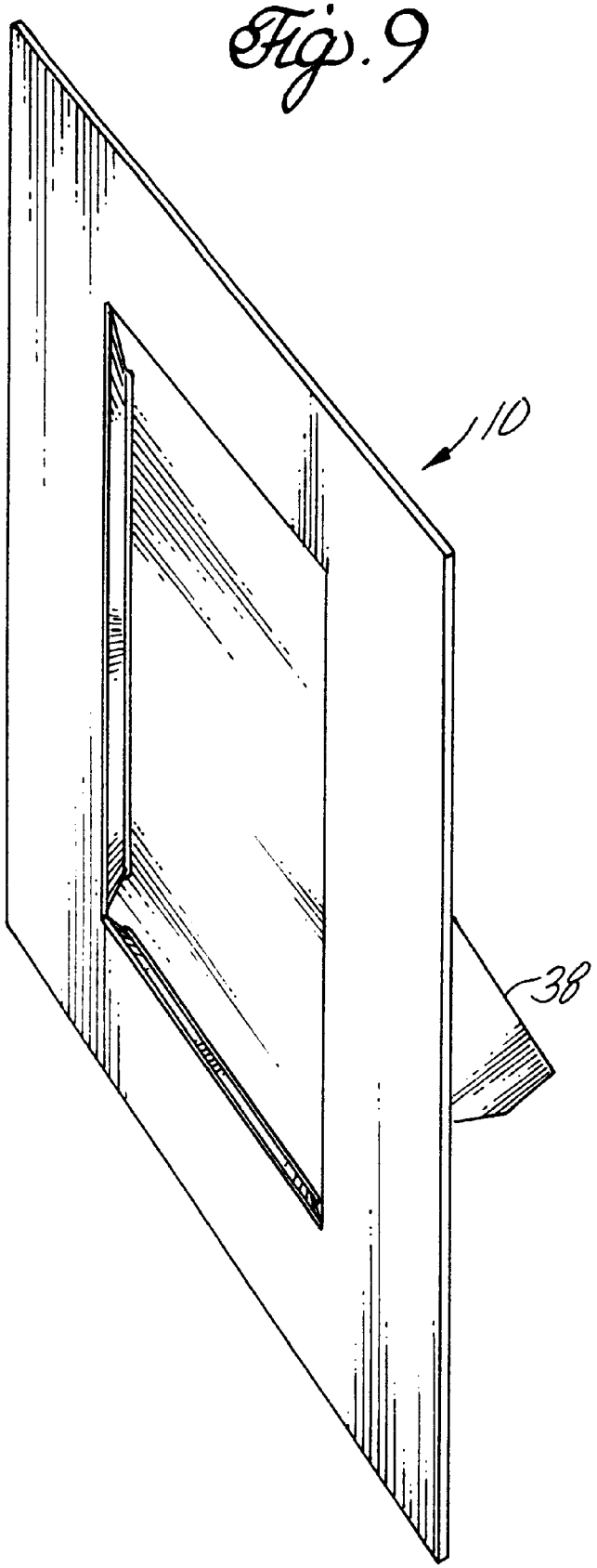
FIG. 9 is a front perspective view of the display device of the present invention showing the frame with foldable flaps engaged with its associated slots in the intermediate panel without a photograph or pictorial display in the display window.

As seen in FIG. 9, the engagement of the four flaps with the four slots causes the front panel 12 to be spaced from the adjacent panel behind it providing a three dimensional or depth effect to the display area of the frame, enhancing the functionality of the frame and the display of the photograph or picture in the display area.

Assembly of flaps 32 and 34 into engagement with their respective slots creates a structure where the four edges and the corners of the photograph are engaged under the display area by the cooperative engagement of flaps and slots to provide a secure positive mounting for the photograph, locking it in position where it cannot shift or slip.

Figure 7:
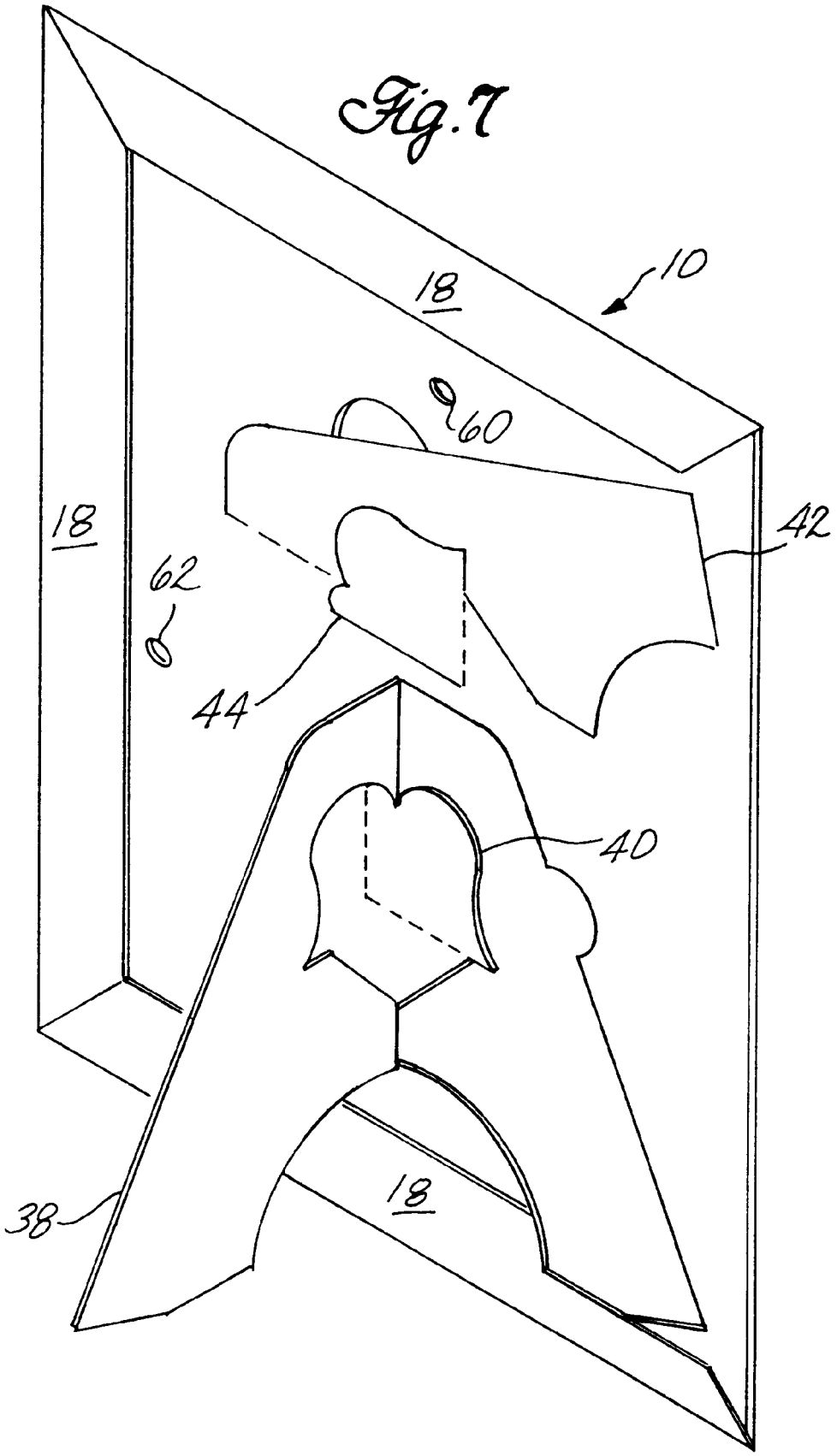
FIG. 7 is a rear perspective view of the display device with one of the easels deployed and the device set up on a display surface.

An easel such as easel 38 is then opened and bent at a 90° angle to the plane of the display device, and flap 40 is engaged with the easel to lock it in the open position and hold it in place, see FIGS. 7 and 9. The frame is then ready for placement on a display surface. Alternatively, easel 42 is used when it is desired to set up the display device with its long axis horizontally oriented. As previously indicated, the invention lends itself equally to being rendered in rectangular or square formats.

I claim:

1. A display device comprising:

an integral flat sheet of paperboard material having first, second and third panels approximately equal in size connected by folding joints between adjacent panels, the third panel being adapted to be folded over the second, and the first panel being adapted to be folded over the second and third panels;

the first panel having an opening of a predetermined configuration defined by four foldable flaps die-cut into the sheet and three elongated tabs along each of the free edges of said first panel for being folded over and secured to the rear side of the second panel of the device when the third panel is folded over the second panel and the first panel is folded over the second and third panels;

the second panel having at least one easel and an easel supporting tab die-cut into the panel; selected edges of the easel and tab being scored instead of die-cut for ease of folding; and the third panel having four slots each of a predetermined configuration die-cut into the panel, the slots being positioned, shaped and oriented to engage respective ones of the foldable flaps of the first panel when the display device is put into use mounting and displaying a photograph or other pictorial material.

2. A display device according to claim 1 wherein the foldable flaps are arcuately shaped and the opening is generally rectangular, the first pair of flaps having a first length located on opposite sides of the opening and the second pair of flaps having a second length greater than the first length located at right angles to the first pair.

3. A display device according to claim 2 wherein the slots in the third panel have a predetermined configuration for receiving the arcuate flaps and are arranged in opposing pairs, the first pair being of the first length corresponding to the first pair of foldable flaps, and the second pair being of a length greater than the first pair corresponding to the second pair of foldable flaps.

4. A display device according to claim 3 wherein said at least one easel includes a pair of easels die-cut into the second panel, the first easel being oriented to support the display device with its longitudinal axis in a horizontal orientation and the second easel being oriented to support the display device with its longitudinal axis in a vertical orientation.

5. A display device according to claim 4 wherein a first pair of aligned mounting holes are die-cut into the second and third panel for hanging the display device with its longitudinal axis in a horizontal orientation.

6. A display device according to claim 5 wherein a second pair of aligned mounting holes are die-cut into the second and third panels for hanging the display device with its longitudinal axis in a vertical orientation.

7. A display device according to claim 1 wherein the outline of the assembled device is rectangular and the display area is rectangular.

8. A display device according to claim 1 wherein the outline of the assembled device is square and the display area is square.

9. A display device according to claim 1 wherein the foldable flaps are arcuately shaped and the opening is generally square the first pair of flaps having a first length located on opposite sides of the opening, and the second paid of flaps having the same length as the first length located at right angles to the first pair.

10. A display device according to claim 9 wherein the slots in the third panel have a predetermined configuration for receiving the arcuate flaps and are arranged in opposing pairs, the first pair being of the first length corresponding to the first pair of foldable flaps, and the second pair being of the same length as the first pair corresponding to the second pair of foldable flaps.

* * * * *